US005249695A

United States Patent [19]

Luch et al.

[11] Patent Number: 5,249,695

[45] Date of Patent: Oct. 5, 1993

[54] SPOUT FITMENT CLOSURE PLUG

[75] Inventors: Daniel Luch, Los Gatos; Brian M. Adams, Newark, both of Calif.

[73] Assignee: Portola Packaging, Inc., San Jose, Calif.

[21] Appl. No.: 13,258

[22] Filed: Feb. 3, 1993

Related U.S. Application Data

[63] Continuation of Ser. No. 664,658, Mar. 5, 1991, abandoned.

[51] Int. Cl.[5] ..... B65D 47/10; B65D 17/40

[52] U.S. Cl. ..... 220/276; 220/254; 220/265; 220/266; 220/270; 229/125.15; 229/125.17; 222/541; 222/563

[58] Field of Search ..... 220/265, 254, 266, 270, 220/276, 359; 229/125.15, 125.17; 222/541, 562, 563

[56] References Cited

U.S. PATENT DOCUMENTS

| | | | |
|---|---|---|---|
| 3,187,966 | 6/1965 | Klygis | 220/265 X |
| 3,608,771 | 9/1971 | Monroe et al. | 220/266 |
| 3,998,354 | 12/1976 | Song | 220/269 |
| 4,019,663 | 4/1977 | Krautkramer | 222/529 |
| 4,146,148 | 3/1979 | Dwinell et al. | 220/270 |
| 4,174,051 | 11/1979 | Edwards et al. | 220/465 X |
| 4,231,486 | 11/1980 | Bock | 220/266 |
| 4,669,640 | 6/1987 | Ando et al. | 220/359 X |
| 4,830,273 | 5/1989 | Kalberer et al. | 229/123.1 |
| 4,909,434 | 3/1990 | Jones et al. | 229/125.15 |
| 4,964,562 | 10/1990 | Gordon | 229/125.15 |
| 5,020,686 | 6/1991 | Dutt | 220/276 |

FOREIGN PATENT DOCUMENTS

| | | | |
|---|---|---|---|
| 1057012 | 5/1959 | Fed. Rep. of Germany | 220/265 |
| WO90/03919 | 4/1990 | PCT Int'l Appl. . | |

*Primary Examiner*—Allan N. Shoap
*Assistant Examiner*—Vanessa Caretto
*Attorney, Agent, or Firm*—Julian Caplan

[57] ABSTRACT

For tent-type paperboard containers as well as other containers, a spout fitment is attached surrounding a hole in the container. The fitment spout has internal threads and an external flange which seals around the hole and is fixed to the container by thermal means, adhesive or the like. The cap has a top disk from which an externally threaded skirt depends. The exterior of the skirt has gripping ribs to assist in screwing and unscrewing the cap. The lower edge of the skirt seals against a sealing membrane on the spout. Surrounding the skirt is a tamper-evident band attached to the lower edges of the ribs by frangible bridges. The tamper-evident band has locking means engaging complementary locking means on the fitment. Thus, the cap cannot be unscrewed without removing the tamper-evident band. By unique design, the fitment and cap may be molded in one mold cavity.

5 Claims, 6 Drawing Sheets

SPOUT FITMENT CLOSURE PLUG

This is a continuation of application Ser. No. 07/664,658, filed Mar. 5, 1991, now abandoned.

BACKGROUND OF THE INVENTION

1. Field of the Invention

This invention relates to a new and improved spout fitment and plug for closing the same. More particularly the invention relates to a fitment which fits around a hole in a panel of a paperboard carton or around a hole in a flexible container, or the like, such as used for packaging liquid products and powders and to a closure for such fitment.

2. Description of Related Art

A typical prior art fitment and cap is shown in FIG. 1 of the accompanying drawings and is discussed in the preferred embodiments portion of this specification. Generally speaking, prior fitments have spouts with external threads closed by caps with internal threads. Some fitments are used in conjunction with plastic bag containers, the fitment being integrally welded to the plastic bag. Other prior art fitments are attached to a polymer-coated paperboard container such as a gable-topped half-gallon container. Generally, prior art fitments for paperboard cartons include a thin flange which is welded to the surface of the container. The closure includes a foil seal which seals the mouth of the spout and a liner for the cap which serves a resealing function. Attachment to the polymer-coated paperboard is accomplished by welding the flange of the spout to the polymer coating. Upon initial removal, the tamper-evident foil seal is removed and discarded.

Fitments of the prior art have a number of deficiencies as compared with the present invention. In the first place, they employ multiple components which increase the cost of the combination very greatly over the simple structure of the present invention. Secondly, assembly is difficult and involves rotary equipment which is difficult to control in practice and is expensive to install. Thirdly, because of the fact that the prior art spouts are externally threaded, the diameter of the opening in the spout is restricted inasmuch as there is only limited space on the panel of the container on which the flange can be located, thereby reducing the diameter of the fitment flange and correspondingly the diameter of the spout. Finally, commercially available fitment-closure combinations have no external tamper-evident features (as contrasted with the internal foil seal of the spout opening).

SUMMARY OF THE INVENTION

One embodiment of the present invention employs a fitment having a spout which is internally threaded and having a flange or other means which is welded or otherwise adhered to the container panel on which the fitment is installed. The closure is an externally threaded plug closure which seals against a membrane on the fitment, which membrane also protects the exposed edge of the hole formed in the container panel. A tamper-evident band on the closure is joined to the closure by a plurality of frangible bridges or the parts may be initially connected by other frangible means. Assembly of the cap on the fitment is preferably performed by a direct axial pushing movement, the threads slipping past each other during the axial movement. The lower edge of the tamper-evident band has engagement means which fit into complementary engagement means on the spout. The inter-engagement of these means prevents rotation of the cap so long as the bridges which join the band to the cap are intact. Thus, after axial assembly the threaded plug cannot be removed prior to removal of the tamper evident band.

As an additional feature, the plug and spout may be molded simultaneously in a single cavity in an injection molding machine. Further, as the parts are ejected from the cavity, the threaded plug may be moved axially so that it fits inside the spout and the threads of the spout and plug inter-engage.

In another embodiment, the parts may be interfitted by a friction fit between the exterior of the plug and the interior of the spout.

As those skilled in the art will realize, materials such as polyolefins having relatively high flexibility and toughness will be most suitable in practice of the invention.

DESCRIPTION OF DRAWINGS

The accompanying drawings, which are incorporated in and form a part of this specification, illustrate embodiments of the invention and, together with the description, serve to explain the principles of the invention.

DESCRIPTION OF PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
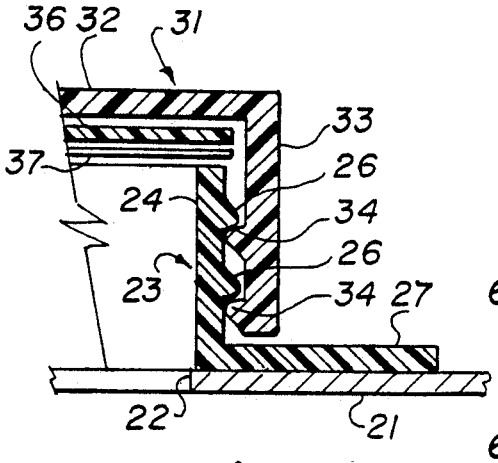
Fig. 1 PRIOR ART
FIG. 1 is a fragmentary sectional view of a portion of a prior art fitment and closure assembly.
Figure 2:
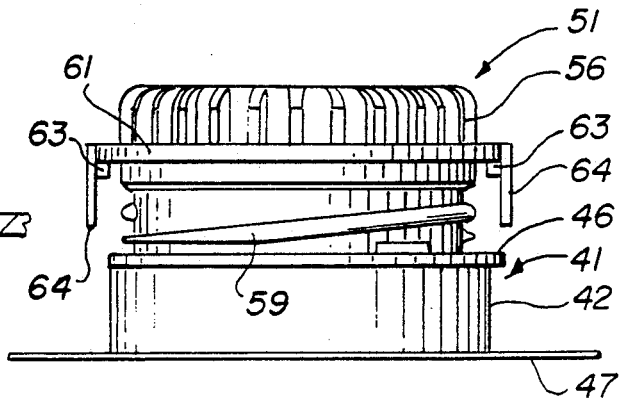
FIG. 2 is a side elevational view of a fitment and closure in accordance with the present invention prior to assembly.

Directing attention now to the typical prior art structure shown in FIG. 1, a carton of paperboard coated with a suitable polymer has a panel 21 formed with a hole 22. Surrounding hole 22 is a fitment 23 having an upstanding spout 24 formed with external threads 26. The lower edge of spout 24 has an external flange 27 which is caused to adhere to the panel 21 by welding, adhesive or other suitable means.

The prior art cap 31 has a top disk 32 from which depends a skirt 33 having internal threads 34 mating with the threads 26. Initially, the cap 31 may be provided with a liner 36 which functions as a re-closure seal and also with a foil seal 37 which seals against the upper end of the spout 24 and provides tamper-evident features. Once the seal 37 is removed, the liner 36 performs a sealing function on re-closure.

Some of the advantages of the present invention over prior art structures such as the typical assembly shown in FIG. 1 have heretofore been described.

A preferred structure of the present invention is shown in FIGS. 2–11. Fitment 41 has an upstanding spout 42 formed with a top edge 43 and having internal threads 44. Preferably the threads 44 are multiple lead threads, since (as hereinafter described) this balances the gating of the spout (see below descriptions of FIGS. 10 and 11).

Figure 3:
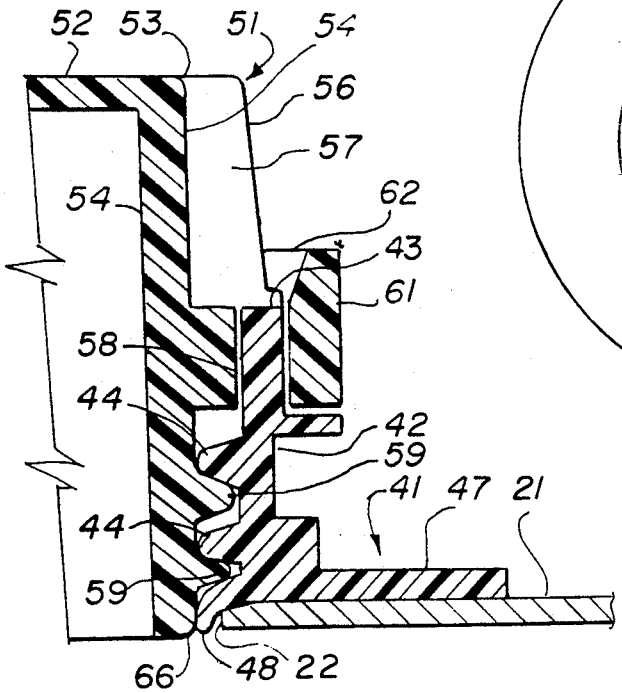
FIG. 3 is an enlarged fragmentary sectional view through an assembled closure and fitment attached to the panel of a container.

Below threads 44, spout is formed with a downward-inward slanted seal membrane 48 which, as shown in FIG. 3, performs a sealing function with the closure as hereinafter appears. Diametrically opposed ratchets 46 are formed in the top edge 43 for the purpose of locking with the tamper-evident band of the closure as hereinafter appears. At the bottom of the fitment is an enlarged peripheral flange 47, the underside of which is caused to adhere to the panel 21.

Closure 51 functions as a plug to close the spout 42. It is formed with a top disk 52 having a rounded corner 53 from which depends a skirt 54. The upper portion of skirt 54 is formed with vertical ribs 56 which extend around the corner 53 and partially inward of the disk 52. Ribs 56 are separated by spaces 57. By gripping the ribs 56 the user may turn the closure 51. Midway of the skirt 54 and immediately below the ribs 56 is an external wall 58 and below the wall 58 are threads 59 which mate with the threads 44.

Surrounding the skirt 54 is a narrow tamper-evident band 61 which is connected to the lower ends of some of the ribs 56 by horizontal frangible bridges 62. At diametrically spaced positions on the under side of band 61 are depending pawls 63 which engage the ratchets 46 of spout 42 to restrain rotation of closure 51 relative to fitment 41 so long as the bridges 62 are intact. One or more tear tabs 64 (here shown as two in number and depending from band 61 immediately outward of pawls 63) are attached to the band 61. By pulling the tab 64 outward, the band 61 may be disconnected from the closure 51 and the closure may be turned relative to the fitment since the pawls 63 are out of engagement with the ratchets 46. However, the removal of band 61 or any tearing of the bridges 62 gives evidence of tampering with the contents of the container. To facilitate removal, bridges 62 are 5 and 6)

The consumer may turn closure 51 to open and close the container. In the closed condition, the end 66 of the skirt 54 seals against the seal member 48 of fitment 41.

Figure 4:
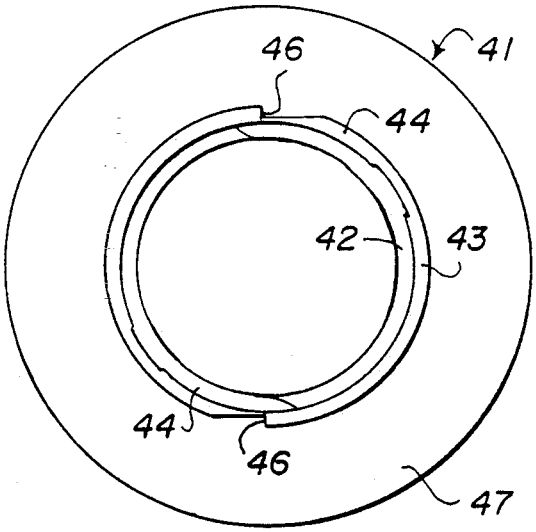
FIG. 4 is a top plan view of a fitment.
Figure 5:
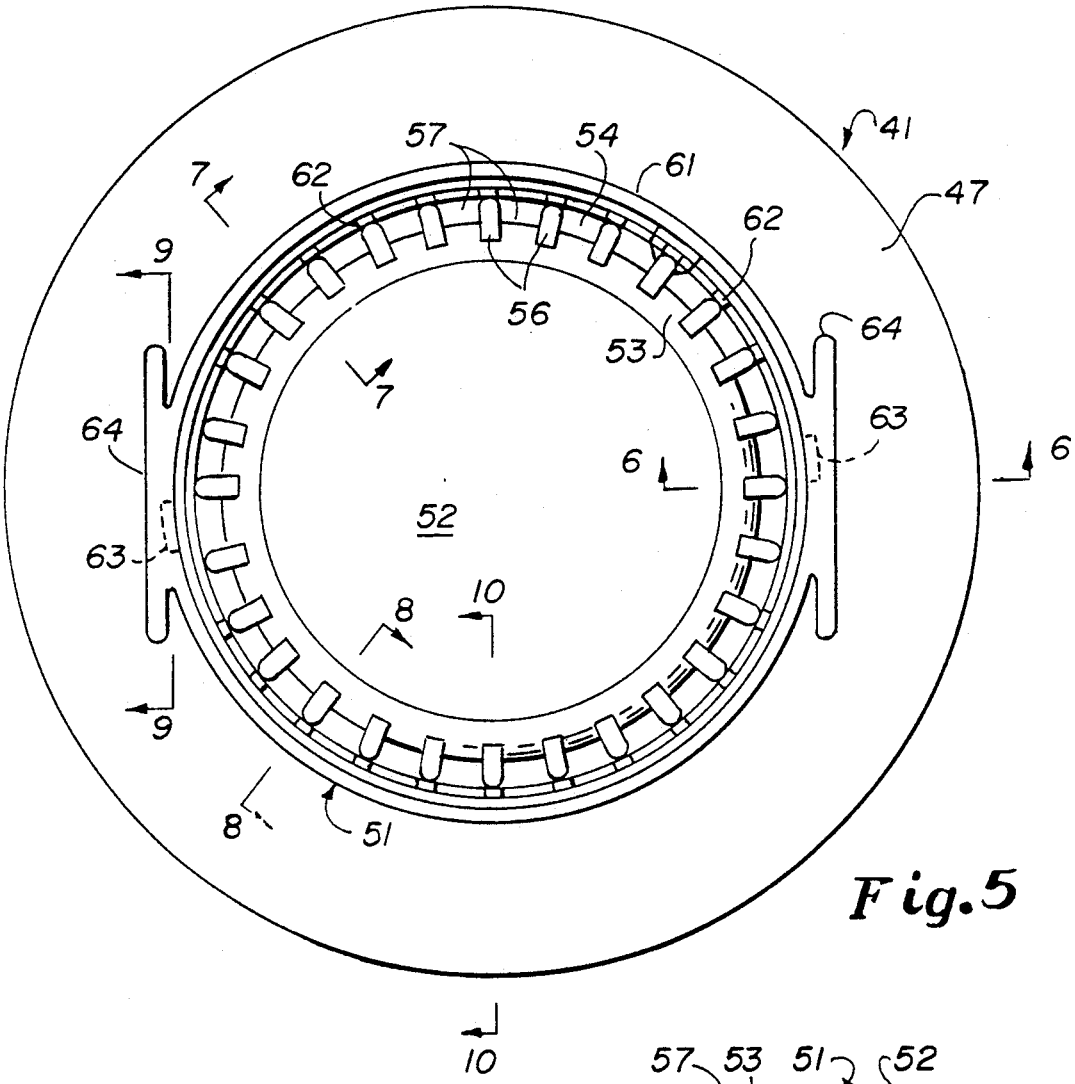
FIG. 5 is a top plan view of a closure.
Figure 6:
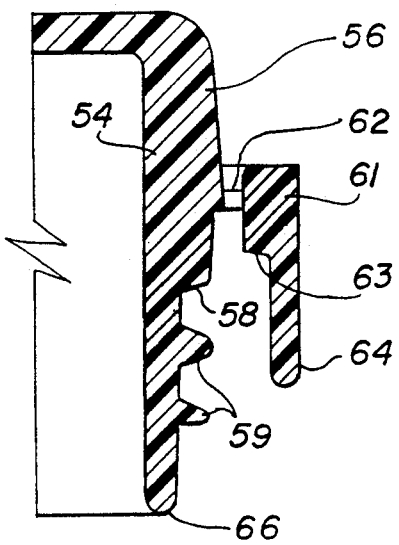
FIGS. 6, 7, 8 and 9 are fragmentary sectional views taken substantially along the lines 6—6, 7—7, and 8—8 and 9—9, respectively, of FIG. 5.
Figure 7:
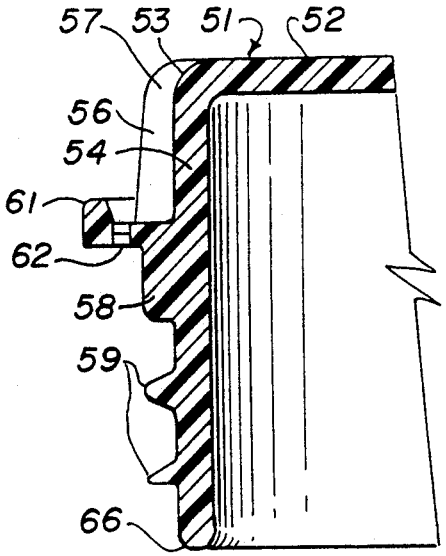
Figure 8:
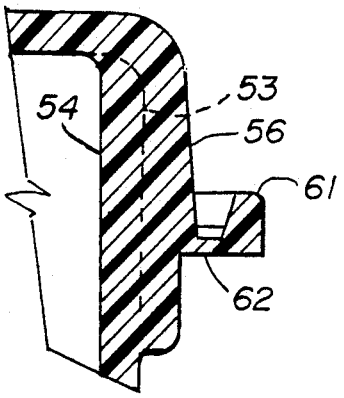
Figure 9:
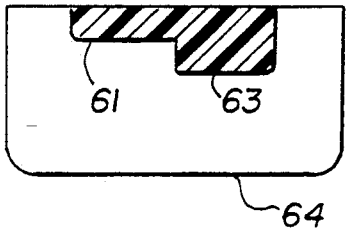
Figure 11:
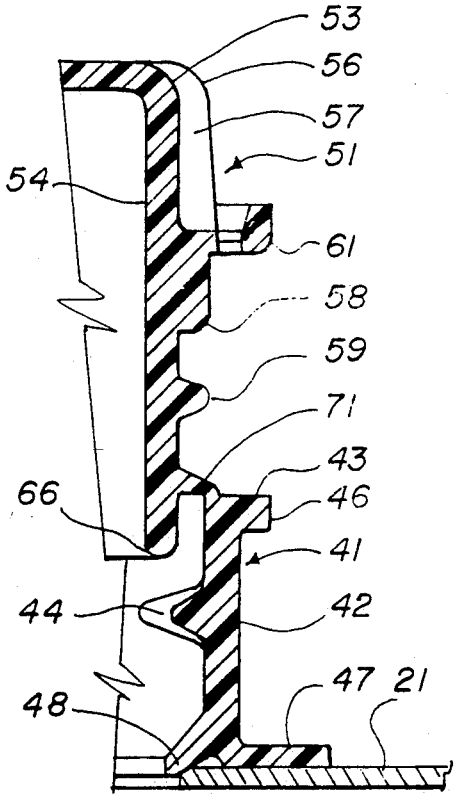
FIG. 11 is a fragmentary sectional view similar to structure to FIG. 10 but angularly rotated to show the integral connection between closure and spout.
Figure 10:
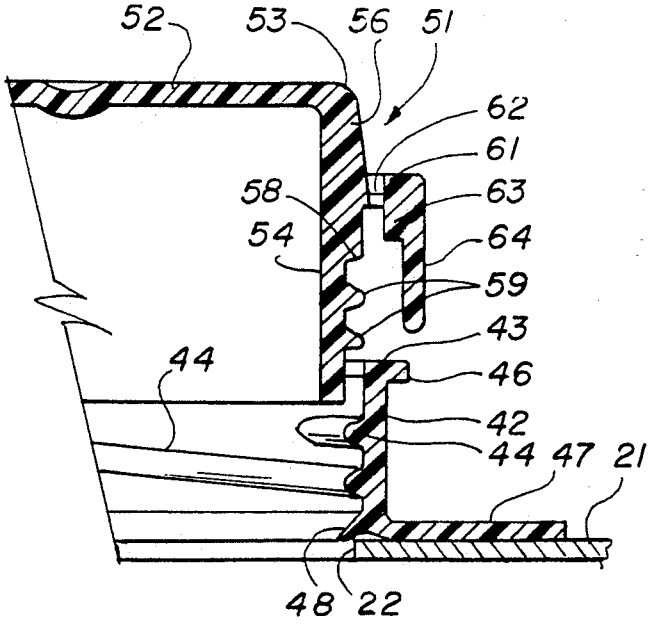
FIG. 10 is an enlarged vertical sectional view through the structure of FIG. 2.

One preferred means for the production of the fitment 41 and closure 51 is shown in FIGS. 10 and 11 whereby the two parts may be made simultaneously in a single cavity of a plastic injection mold. Thus in the mold, the fitment 41 is positioned below the closure 51. As shown in FIG. 11, there are gates 71 connecting the fitment to the closure. Gates 71 are positioned to coincide with the theoretical projections of the lower ends (or run-outs) of helical threads 59. The plastic is injected at the top of the closure and the molten plastic extends through the gates 71 into the top of the spout 42. Accordingly the two parts may be molded simultaneously. In order to separate the parts, the gates 71 is fractured. Such fracture may be accomplished merely by pushing axially downward on the closure, the threads 59 slipping over the threads 44. After fracture there are remnants 72 and 73 of the gate 71 on the closure 51 and spout 42 respectively. FIG. 4 shows remnant 73 of gate 71 on spout 42. FIGS. 6 and 7 show remnants 72 of gate 71 on closure 51. It will be understood, however, that the parts may be molded separately. When molded simultaneously, by proper mold construction, the parts may be assembled before being ejected from the mold.

Figure 12:
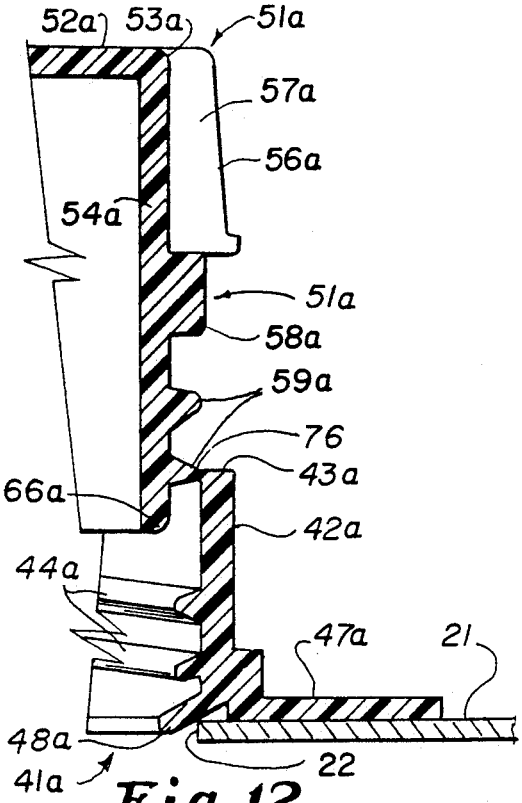
FIGS. 12, 13, and 14 are, respectively, modifications of the structure of FIGS. 1-11, taken substantially along the same lines as FIG. 11.

FIG. 12 illustrates an alternate construction. In this modification, a continuous frangible web connection 76 connects the plug to the top edge **43*a* circumferentially around the parts. The parts may be installed on the container in the condition shown in FIG. 12. So long as the connector 76 is intact, the consumer is assured that there has been no tampering with the container. At the time of consumption, the user fractures the connection 76 either by twisting the closure 51*a* or other convenient means. The closure 51*a* may be installed on the fitment 41*a* after part of the contents of the container have been dispensed merely by screwing the closure 51*a* into the spout 42**.

Figure 13:
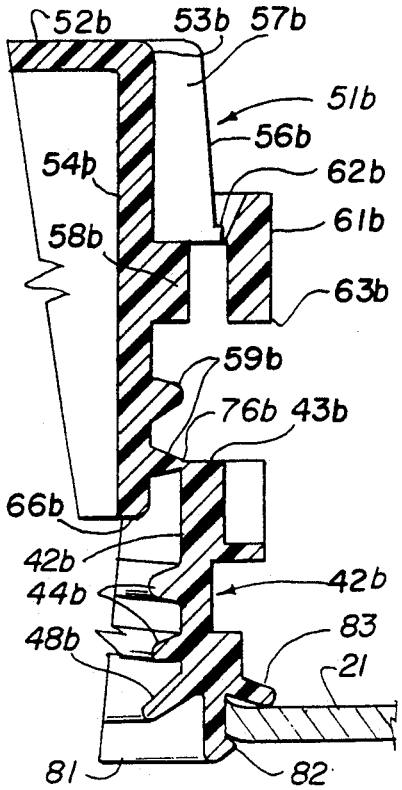

In the form of the invention shown in FIG. 13, which is particularly useful where the device is to be attached to a container having solid contents, the lower end of the fitment **41*b* has a downward extending ring 81 which fits inside the hole 22 and is retained therein by an outward extending barb 82 which engages under the panel 21. To stabilize and also to seal the fitment, an outer seal member 83 similar to the seal member 48*b* engages the top surface of the panel 21. In FIG. 13 the parts are shown prior to assembly of the plug to fitment spout. It will be understood that normally a closure 51*b* is attached to the fitment 41*b* before the ring 81 is inserted in the panel 21**.

Figure 14:
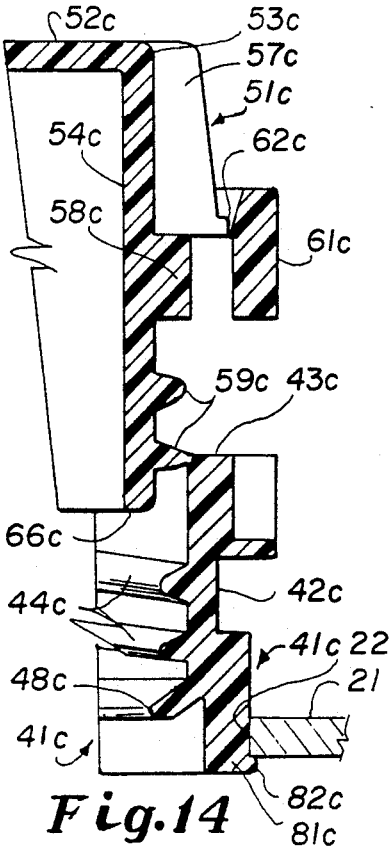

FIG. 14 shows still another modification. The structure in FIG. 14 is substantially similar to that in FIG. 13 except that the stabilizing seal member 83 of FIG. 13 is omitted.

Figure 15:
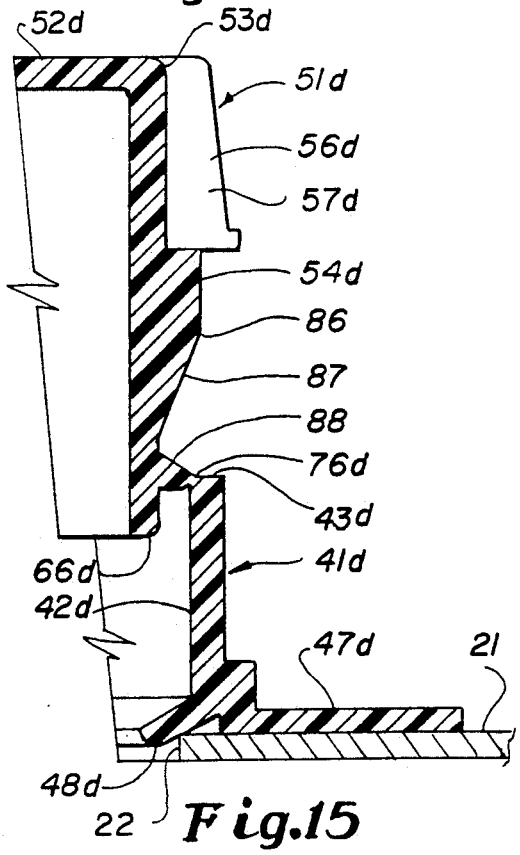
FIG. 15 is a view similar to FIG. 14 of still another modified combination.

FIG. 15 shows a very simple, tamper-evident construction. No threads are required on the closure or spout. Rather, the exterior of skirt **54*d*, immediately below ribs 56*d* is formed with a cylindrical external sealing surface 86 and below surface 86 is an undercut 87 merging into outward curved portion 88. Portion 88 extends around the circumference of closure 51*d* and is joined to the inner corner of top edge 43*d* of fitment 41*d* by a frangible circumferential web 76*d***.

Web **76*d* makes the combination tamper-evident since the container cannot be opened without breaking the same. When the consumer wishes to open the container, closure 51***d* is disconnected from fitment 41*d* by breaking web 76*d* by any convenient means. For reclosure purposes, sealing end 66*d* contacts seal member 48*d*.

Figure 16:
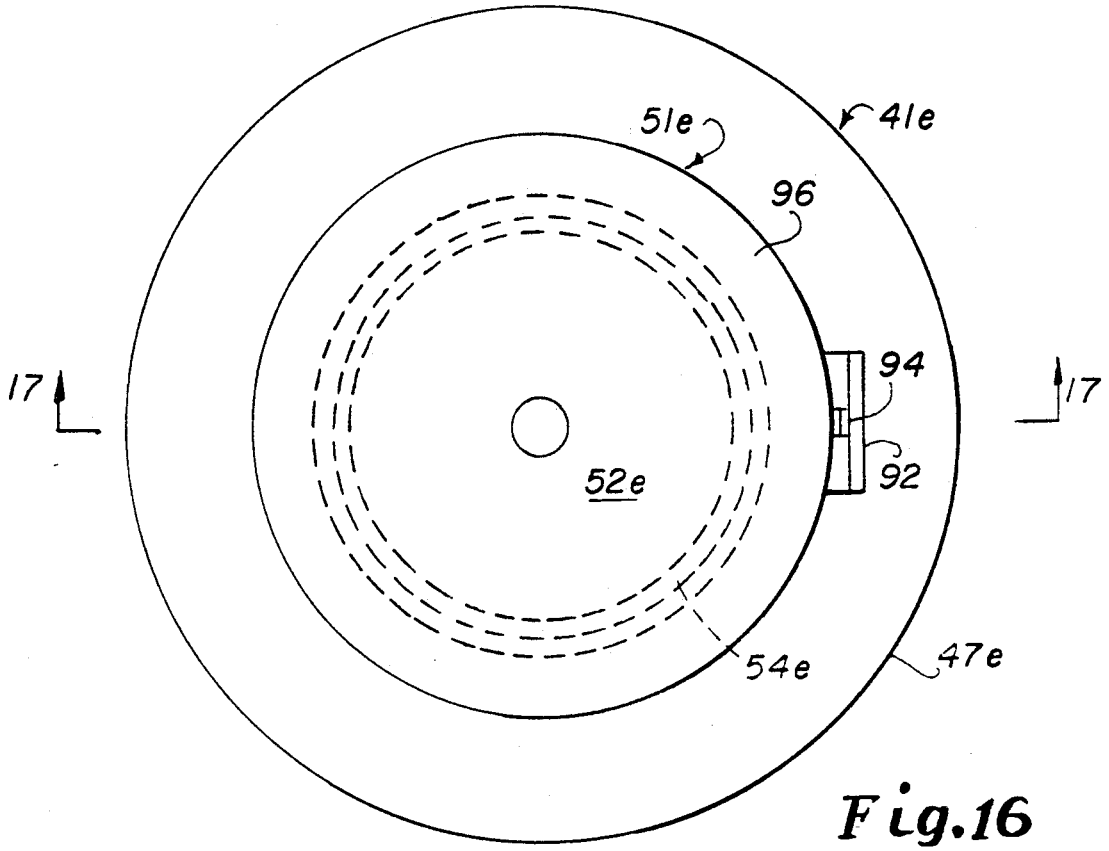
FIG. 16 is a top plan view of a still further modification of the invention.
Figure 17:
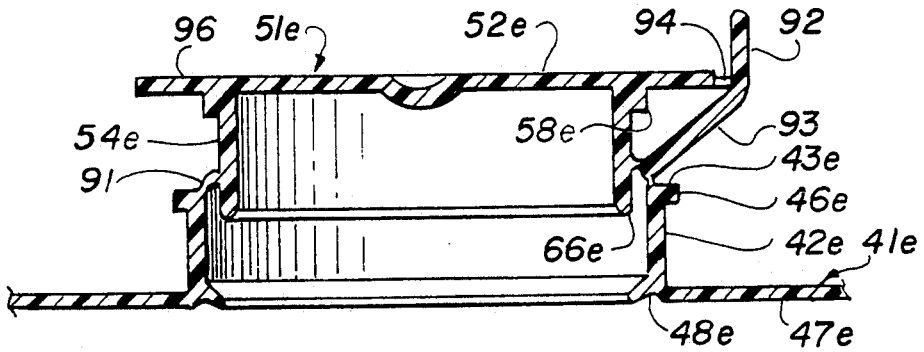
FIG. 17 is a vertical sectional view taken substantially along line 17—17 of FIG. 16 showing the combined closure and fitment in initial condition.
Figure 18:
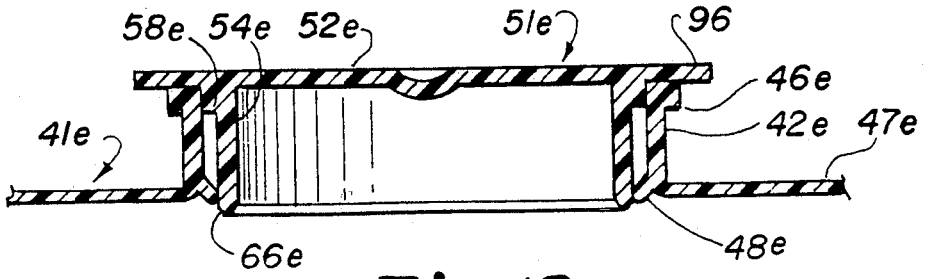
FIG. 18 is a view similar to FIG. 17 showing the parts in re-closure position.

FIGS. 16–18 illustrate a further modification wherein the closure 51*e* and fitment 41*e* are molded together and, as initially molded, provide a tamper-evident combination which is liquid-tight. When the consumer separates the two parts, the closure may be used for reclosure purposes.

Thus spout 42*e* need not be threaded. Closure 51*e* is joined to the upper edge 43*e* of spout 42*e* in a frangible, continuous, circumferential tear band 91 which functions as a connection or gate during molding of the parts and further makes the parts in the condition shown in FIG. 17 tamper-evident. In the preferred form best shown in FIG. 17, circumferential flange 96 extends horizontally out from top disk 52*e* beyond the confines of skirt 54*e*. At one or more positions around the circumference of band 91 is a pull tab 92, of limited width, which may extend up above the level of closure top disk 52*e* and out beyond the edge of flange 96 so that it is conveniently gripped by the consumer. Below the level of flange 96, tab 92 slants downward-inward to join tear band 91. At least one point, tab 92 is connected to the edge of flange 96 by one or more frangible bridges 94 which helps stabilize the tab and also makes additional contribution to tamper-evidency.

The flange 47*e* may be adhered around a hole in a container with the combination shown in FIG. 17 intact and tamper-evident since as long as bridge 94 and tear band 91 are intact the user cannot obtain access to the contents of the container. To open the container, the consumer grasps tab 92, breaking bridge 94 and then tear band 91. Closure 51*e* is then removed by gripping flange 96.

For reclosure skirt 54*e* is inserted in spout 42*e* and top 52*e* pushed downward. Collar 58*e* seals against the inside of spout 42*e* and seal member 48*e* seals against the outside of skirt 66*e*, both sealing with a friction fit. Flange 96 seats on top edge 43*e*, limiting downward movement of the closure. The closure 51*e* may be removed by gripping flange 96 and replaced repeatedly.

Figure 19:
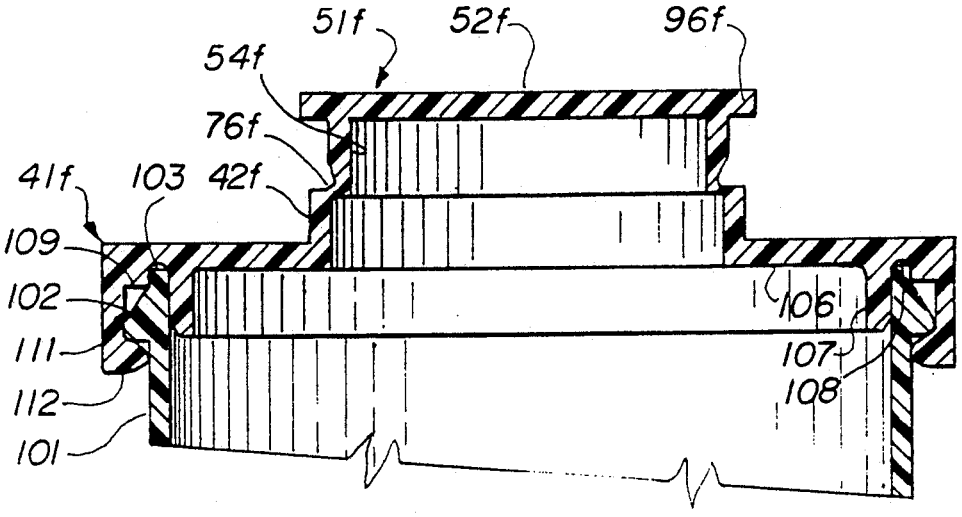
FIGS. 19 and 20 are vertical sectional views of a modification showing a different mechanism for attachment to the container.
Figure 20:
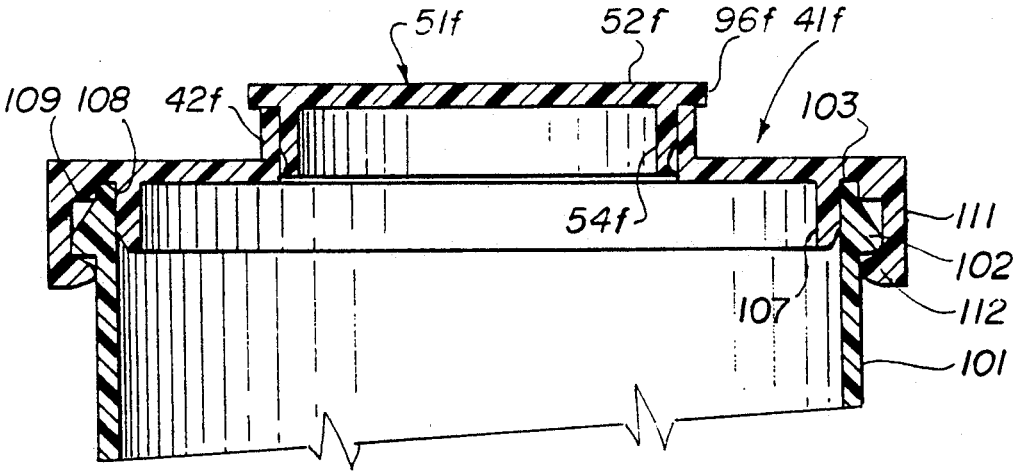

In the modification of FIGS. 19–20, fitment 41*f* is applied to a container 101 of any convenient type such as one having an external locking bead 102 below top edge 103. Fitment 41*f* has an annular top 106 having upward extending spout 42*f*. The underside of top 106 has an inner skirt or hollow plug 107 which fits inside the wall of container 101. Outward of plug 107 is a groove 108 which receives edge 103 and beyond groove 108 is a shoulder 109 which fits against the upper outer edge of container wall 101. A peripheral short skirt 111 has an internal bead 112 which locks under bead 102.

The closure 51*f* is quite similar to that of FIGS. 16–18 except that skirt 54*f* may be dimensioned to fit tightly within spout 42*f* without use of a collar such as collar 58*e* of FIG. 17. The lower edge of skirt 54*f* is bevelled and is initially connected by frangible connector 76*f* to the inner edge of the upper end of spout 42*f*.

The closure as shown in FIG. 19 is tamper-evident. The consumer grasps closure 51*f*, breaking connector 76*f*. For reclosure purposes, closure skirt 54*f* is inserted in spout 42*f* and pushed down to assume the closed position shown in FIG. 20.

Remnants similar to remnant 72 and 73 of the modification of FIGS. 1–11 remain on the closures and spouts of the modifications of FIGS. 12–20 after the frangible connections 76 through 76*f* have been broken. Such remnants do not appear in FIGS. 12–18 because the views show the molded closures and fitments before being broken.

In many respects the modifications of FIGS. 12, 13, 14, 15, 17 and 19 resemble those of the preceding modifications, and the same reference numerals followed by the subscripts a, b, c, d, e and f, respectively, are used to designate corresponding parts.

What is claimed is:

1. In combination, a fitment and a closure therefor, said fitment comprising a spout having an interior and an exterior formed with internal first engagement means, attachment means for attaching said fitment vicinal an aperture in a container, said closure having a top, a skirt having an interior and an exterior, said skirt depending from said top, formed with external second engagement means engageable with said first engagement means, and breakable means interconnecting a portion of said fitment and said skirt, said breakable means being positioned so that said closure cannot be moved relative to said fitment without breaking said breakable means, and said breakable means comprises a tamper-evident tear band interconnecting said spout and the exterior of said skirt and a tear tab connected to said tear band, whereby by pulling said tear tab said tear band is removed and said closure may be separated from said fitment, said skirt in initial condition being partially inserted with said spout.

2. The combination of claim 1 which further comprises at least one frangible bridge connecting said tear tab to said top whereby said bridge must be broken before removal of said tear tab.

3. The combination of claim 1 in which said first engagement means comprises a seal member on said interior of said spout engageable with said exterior of said skirt.

4. The combination of claim 3 in which said second engagement means comprises a collar on said exterior of said skirt which engages the interior of said spout.

5. The combination of claim 1 which further comprises a sealing member extending inward from adjacent to the bottom of said interior of said spout to engage said skirt.

* * * * *